US011041700B2

(12) United States Patent
Bengtsson

(10) Patent No.: US 11,041,700 B2
(45) Date of Patent: Jun. 22, 2021

(54) COUNTER MASS CONTAINER FOR A WEAPON

(71) Applicant: SAAB AB, Linkoeping (SE)

(72) Inventor: Ulf Bengtsson, Lagos (PT)

(73) Assignee: SAAB AB, Linkoeping (SE)

( * ) Notice: Subject to any disclaimer, the term of this patent is extended or adjusted under 35 U.S.C. 154(b) by 0 days.

(21) Appl. No.: 16/469,196

(22) PCT Filed: Dec. 5, 2017

(86) PCT No.: PCT/SE2017/051213
§ 371 (c)(1),
(2) Date: Jun. 13, 2019

(87) PCT Pub. No.: WO2018/111175
PCT Pub. Date: Jun. 21, 2018

(65) Prior Publication Data

US 2020/0025534 A1 Jan. 23, 2020

(30) Foreign Application Priority Data

Dec. 15, 2016 (SE) ..... 1600345-1

(51) Int. Cl.

| | |
|---|---|
| ***F41A 1/10*** | (2006.01) |
| ***F42B 5/05*** | (2006.01) |
| ***F42B 5/02*** | (2006.01) |
| ***F42B 5/16*** | (2006.01) |

(52) U.S. Cl.
CPC ..... *F42B 5/05* (2013.01); *F42B 5/025* (2013.01); *F42B 5/16* (2013.01); *F41A 1/10* (2013.01)

(58) Field of Classification Search
CPC ..... F41A 1/10; F41A 25/06; F42B 5/05
USPC ..... 89/1.701, 1.703
See application file for complete search history.

(56) References Cited

U.S. PATENT DOCUMENTS

| | | | | |
|---|---|---|---|---|
| 3,796,128 | A | 3/1974 | Zeyher | |
| 5,337,648 | A | 8/1994 | Brage | |
| 6,408,731 | B1 | 6/2002 | Elsener | |
| 7,263,855 | B2 * | 9/2007 | Meyer | F25D 11/003 62/371 |
| 2005/0217468 | A1 | 10/2005 | Ax et al. | |
| 2010/0282054 | A1 | 11/2010 | Ax et al. | |

(Continued)

FOREIGN PATENT DOCUMENTS

| | | | | |
|---|---|---|---|---|
| CH | 309598 A | | 9/1955 | |
| GB | 577320 A | * | 5/1946 | F41A 1/10 |
| SE | 374601 B | | 3/1975 | |

OTHER PUBLICATIONS

International Searching Authority, International Search Report and Written Opinion for International Application No. PCT/SE2017/051213, dated Feb. 16, 2018, 10 pages, Swedish Patent and Registration Office, Stockholm, Sweden.

(Continued)

*Primary Examiner* — Reginald S Tillman, Jr.
(74) *Attorney, Agent, or Firm* — Alston & Bird LLP

(57) ABSTRACT

The present invention relates to a counter mass container (2) enclosing a plurality of parallel axially extending channels (1). The invention also relates to an assembly of a plurality of such counter mass containers (2). The invention also relates to a weapon comprising a barrel (5) accommodating such an assembly.

19 Claims, 5 Drawing Sheets

(56) References Cited

U.S. PATENT DOCUMENTS

2015/0059566 A1 3/2015 Nilsson

OTHER PUBLICATIONS

European Patent Office, Extended European Search Report for Application No. 17880937.2, dated Jul. 10, 2020, 9 pages, Germany.

* cited by examiner

COUNTER MASS CONTAINER FOR A WEAPON

CROSS REFERENCE TO RELATED APPLICATIONS

This application is a National Stage Application, filed under 35 U.S.C. 371, of International Application No. PCT/SE2017/051213, filed Dec. 5, 2017, which claims priority to Swedish Application No. 1600345-1, filed Dec. 15, 2016; the contents of both of which are hereby incorporated by reference in their entirety.

BACKGROUND

Related Field

The present invention relates to a counter mass container and a propellant container. The invention also relates to an assembly comprising at least one counter mass container and at least one propellant container, and to a recoilless weapon accommodating such assembly.

Description of Related Art

Various methods for compensating for recoiling forces occurring subsequent to firing of projectiles in weapons such as anti-tank weapons and anti-armor weapons are known in the art. If no oppositely directed impulse is created, recoiling forces may render the weapon unusable to the operator for security reasons. One way of coping with this problem is to arrange a conical compression/expansion Laval nozzle at the rear end of the weapon ventilating combusted propellant gases at high supersonic velocity to provide for a counter-force. Another way of coping with this problem is to use a counter mass that is accelerated backwards at sonic velocity in the barrel when a projectile is fired under gas pressure created by gun powder (propellant) expanding between the projectile and the counter mass. This principle is used for example in the original recoilless Davis Gun design.

However, when using recoilless weapons based on the counter mass principle, symmetry problems may occur affecting inter alia the hit rate. One example of such symmetry problem occurs when the counter mass is obliquely ejected. One influencing factor of such occurrence may be asymmetrical gas ventilation arising around the counter mass which in turn may result in pressure differences arising at the rear part of the barrel which also may turn the weapon at the firing phase.

One objective of the present invention is to reduce the pressure increase in the vicinity of a gunner compared to conventional technology which enables use of the invention in confined spaces, e.g. in urban locations without security risks for the gunner. A further objective of the invention is to eliminate the problem related to undispersed counter mass material subsequent to release thereof. A further object of the invention is to ascertain homogeneous distribution of counter mass material stored and transported in a counter mass container according to the invention.

BRIEF SUMMARY

The present invention relates to a counter mass container enclosing a plurality of parallel axially extending channels. According to one embodiment, at least one extending channel, preferably two extending channels or more than two extending channels contain countermass, preferably in an amount adapted to the firearm in which the counter mass and countermass container is arranged. According to one embodiment, the counter mass container contains a counter mass material in at least one extending channel, preferably at least two extending channels resulting in symmetrical distribution thereof. According to one embodiment, the counter mass container has an axial length ranging from 30 to 150 mm, for example 75 to 150 mm, or for example 75 to 100 mm. According to one embodiment, the counter mass container has a radial length ranging from 6 to 12 cm. According to one embodiment, the channels of the counter mass container have an average diameter ranging from 5 to 30 mm. According to one embodiment, the counter mass container has channel walls having a thickness ranging from 0.1 to 2 mm. According to one embodiment, the counter mass container has a ratio of the axial length to the radial length ranging from 0.3 to 2, preferably from 0.5 to 0.8. According to one embodiment, a surrounding wall encloses the channels suitable to be arranged in a barrel of suitable calibre. According to one embodiment, by the term "counter mass container" is meant to include a container for material counteracting a recoil, preferably a recoil of a weapon, partially or entirely. According to one embodiment, by the term "fuse" is meant to include a cord, tube or any other means for transmission of flame or explosion in an assembly of plural counter mass containers. By the term "axial length" of the counter mass container is meant the length running along the symmetry line of the counter mass container. By the term "radial length" of the counter mass container is meant the average diameter of the container. By the term "channel" is meant an enclosure which may contain counter mass material, propellant, ignition charge and the like and from which channel material eventually can exit subsequent to firing. By the term "plurality of channels" is meant at least two channels. For example, a counter mass container, preferably a cylindrical container, divided into two sections is comprised. Preferably, from about 2 to about 200, more preferably from 5 to about 200, for example from about 50 to about 150 channels are comprised in the counter mass container. According to one embodiment, from 2 to 100, for example from 2 to 50 or 5 to 50, more preferably from 10 to 30 channels are comprised in the counter mass container.

According to one embodiment, preferably for use in a weapon caliber of about 84 mm, the average diameter of the channels ranges from about 5 mm to about 30 mm, preferably from about 6 mm to about 9 mm. According to one embodiment, the cross section of the channels is circular, hexagonal, octagonal, or square-shaped form, preferably square-shaped form.

According to one embodiment, preferably for use in a weapon caliber of about 84 mm, the counter mass container is composed of a plurality of channels with the same or different cross section. Preferably, the diameter of the channels with a weapon caliber if about 84 mm ranges from 5 mm to 30 mm, preferably from 6 mm to 9 mm. According to one embodiment, the counter mass container is constructed of polymers, plastic or the like, preferably a polymer. Preferably, at least one end plate prevents leakage in an axial direction of counter mass material prior to firing when accommodated in a barrel. Preferably, a first end plate is arranged at a certain distance from the rear end of the barrel and a second end plate is arranged at the rear end, thus a certain distance from the first end plate. Preferably, at least two end plates are arranged to allow for smooth breaking up of channels of the containers and homogeneous dispersion of counter mass material in between said at least two end plates. Such breaking up safeguards a solid mass such as a slug eventually hits a gunner. Preferably, the barrel in the region between said at least two end plates is expanding towards the rear end to enhance further smooth and safe break-up of channels. According to one embodiment, an end plate with break indications is comprised. Preferably, said at least one end plate and plurality of channels are broken up subsequent to firing due to increased pressure and heat resulting in mixture of counter mass material and ventilated combusted propellant gases.

According to one embodiment, preferably for use in a weapon caliber of 84 mm, the channels of the counter mass container have an axial length ranging from about 30 mm to about 150 mm, for example 75 to 150 mm, or 75 to 100 mm. The axial length may vary depending on the particular application and counter mass material. Channels may be adapted to any design of weapon used, weight of projectile to be fired, application etc.

According to one embodiment, preferably for use in a weapon caliber of 84 mm, the ratio of the average diameter of the channels to the axial length of the channels ranges from about 0.05 to about 1, preferably from 0.1 to 0.3.

According to one embodiment, various ways of joining or connecting the channels in the counter mass container may be envisaged. Preferably, the channels making up the counter mass container constitute an integral part. According to one embodiment, the channels are fixed to one another, for example by means of any suitable adhesive.

According to one embodiment, the material in the counter mass container may be in solid, liquid or gaseous state, or a mixture thereof. According to one embodiment, the counter mass is a fluid, e.g. a liquid such as water or salt water. Preferably, the counter mass material is so selected it absorbs a considerable quantity of the energy after having expanded, preferably in an exit nozzle, so as to impart a less hazardous back blast.

The invention further relates to an assembly comprising a plurality of counter mass containers as described herein. Preferably, the assembly has a design to fit in a barrel of a weapon in which it is to be used. The diameter of the assembly extending axially comprising the axial channels fits into the barrel and thus can function as a countermass. Thus, the assembly preferably extends axially as a bundle of parallel channels, wherein the diameter of the assembly corresponds to the barrel where it is to be arranged. According to one embodiment, the assembly may comprise from 2 to 100 counter mass containers containing counter mass material in at least one of the channels. According to one embodiment, the assembly comprises at least one propellant container arranged between the plurality of counter mass containers. According to one embodiment, the assembly comprises at least one counter mass container and at least one propellant container positioned adjacent to one another in a barrel. According to one embodiment, the assembly comprises a fuse for igniting propellant arranged between a projectile to be fired and a counter mass container. According to one embodiment, the assembly comprises a propellant container having the same or virtually the same structure and dimensions as the counter mass container. According to one embodiment, also containers containing igniting material may have the same structure and dimensions. For example, the propellant container may have various axial length compared to the counter mass container. It has been found the same channel structure may be of the same importance for propellant as for counter mass material. It has been found dispersion and homogeneous fluidization can be improved by even distribution also of propellant and igniting charge. This also simplifies production and assembling of containers for application in a barrel.

According to one embodiment, an assembly comprising a plurality of counter mass containers may contain different types of counter mass materials in the different counter mass containers. For example, one counter mass container may contain a mixture of solid and liquid counter mass materials whereas further counter mass container(s) merely contains counter mass material in solid state.

According to one embodiment, solid counter mass material is selected from e.g. particles such as particulates, powder, granules, flakes, grits, or mixtures thereof, preferably grits such as steel grit, aluminum grit, or mixtures thereof. The counter mass material may also be selected from various plastics or polymers, preferably polymer, preferably in the form of particles of suitable size. Preferably, the density of the counter mass material ranges from 0.5 to 30 $kg/dm^3$, for example 1 to 10 $kg/dm^3$, for example from 2 to 6 $kg/dm^3$, or from 3 to 5 $kg/dm^3$. According to one embodiment, the total weight of counter mass in one counter mass container ranges from 0.1 to 10 kg, preferably from 0.5 to 5 kg, more preferably from 0.5 to 2 kg, most preferably from 0.5 to 1.5 kg. According to one embodiment, the counter mass material is composed of material absorbing energy to a suitable extent. As an example, solid counter mass material which is converted to liquid or gaseous state may be used in order to absorb energy in the back blast outside rear of the weapon.

According to one embodiment, the particle size of the counter mass material ranges from about 0.2 to about 2 mm, preferably from about 0.2 to about 0.5 mm. By provision of a suitable particle size, the flow of particles out from the counter mass container is of such velocity it rapidly slows down in pace behind the weapon whereby undesired casualties can be avoided.

According to one embodiment, a plurality of counter mass containers is arranged in a barrel with a certain distance between the counter mass containers.

According to one embodiment, the countermass material and the propellant are contained in the same channel. According to one embodiment, the propellant when ignited upon firing builds up a pressure in the space between a counter mass container containing counter mass material and a projectile whereby the combusted propellant gases accelerate the projectile in the fire direction and the counter mass material towards the rear end of the weapon.

According to one embodiment, a fuse is arranged to ignite propellant contained in at least one propellant container arranged between a projectile to be fired and a counter mass container. According to one embodiment, the igniter is a primer which may consist of a conventional percussion cap device, preferably arranged in a control cup that controls the ignition spark of the percussion cap.

According to one embodiment, the propellant is ignited by means of a centrally positioned fuse resulting in an increase in pressure in all cavities of the counter mass and propellant containers.

According to one embodiment, centrally positioned channels may contain an ignition charge. According to one embodiment, channels surrounding the centrally positioned channels may comprise counter mass material. Suitably, combusted gaseous propellants may expand axially throughout an assembly subsequent to the ignition of the ignition charge. A symmetrical flow of gas and counter mass material out of the assembly may thus be obtained resulting in inter alia improved hit rate and less hazardous back blast for any suitable weapon. Preferably, the central channels cover 10 to 80% of the cross section of the container, more preferably from 40 to 60%.

According to one embodiment, a primer is provided at the surface of a container comprising ignition charge and/or propellant. According to one embodiment, a primer is provided at the surface between a first end plate and a container comprising ignition charge and/or propellant. Preferably, the container is positioned at the rear most end of a barrel. According to one embodiment, an ignition charge is provided in the container for ignition charge and/or propellant to provide for ignition of propellant. According to one embodiment, a container comprising ignition charge and/or propellant is positioned at least 100 mm from the rear end of the barrel or at least 100 mm from a first end plate.

According to one embodiment, a plurality of containers of counter mass and propellant respectively provide for fluidization of counter mass material. As the propellant, for example propellant in a propellant container adjacent the projectile is combusted, a fluid of counter mass material and a gaseous propellant travels towards the rear end of the barrel. Simultaneously, a portion of the gaseous propellant travels in the fire direction. As the projectile is propelled in the fire direction, a fluid of gas and counter mass material is effectively flowing backwards symmetrically.

Preferably, the end plate covers the outlet of the counter mass container and thus prevents counter mass material from leaving the channels of the counter mass container.

According to one embodiment, the end plate is provided with a fissured surface or a surface provided with break indications. The break indications may define for example four openable flaps arranged to a folding support. The end plate is thus rendered more liable to breakage compared to a corresponding end plate without fissures. The end plate may be manufactured from reinforced bakelite, a membrane such as a metal membrane being liable to breakage at break indications provided.

Preferably, the counter mass material is maintained in an appropriate manner until firing of a weapon. Preferably, when using any counter mass material, the counter mass container is sealed to ascertain no leakage occurs. Preferably, also propellant and/or ignition charge material have sealed containers.

According to one embodiment, containers of propellant and counter mass are axially arranged adjacent to one another, preferably by fixing propellant and counter mass containers to one another, e.g. by means of glueing with a suitable adhesive. Preferably, the counter mass container has a shape corresponding to and fitting the inner diameter of a barrel and the cartridge or propellant whereby the container may be tightly fixed to the inner surface of the barrel. Preferably, materials and shape of containers and barrels are selected to minimize shearing building recoil.

It has been found a counter mass container provided with a plurality of channels alleviates or at least reduces the problem related to undispersed counter mass material, e.g. material in solid form. The counter mass container according to the invention prevents problems which may occur if counter mass material is stored in a counter mass container without channels for a certain period of time after which a risk arises the counter mass material starts to clog or become unevenly dispersed resulting in inter alia pressure differences in the rear end of a weapon subsequent to firing as the counter mass material exits the barrel. An optimal particle size of the counter mass material may further reduce uneven dispersion of particles.

The components making up the containers for counter mass, propellant, igniting charge etc, and the assembly per se may be manufactured in any suitable material, for example a suitable polymer or mixture of polymers. The components may be manufactured in a conventional 3D printer.

The invention further relates to a weapon comprising a barrel accommodating the assembly described herein. According to one embodiment, the weapon is of reloadable or disposable type, preferably reloadable type.

DETAILED DESCRIPTION OF VARIOUS EMBODIMENTS

Figure 1:
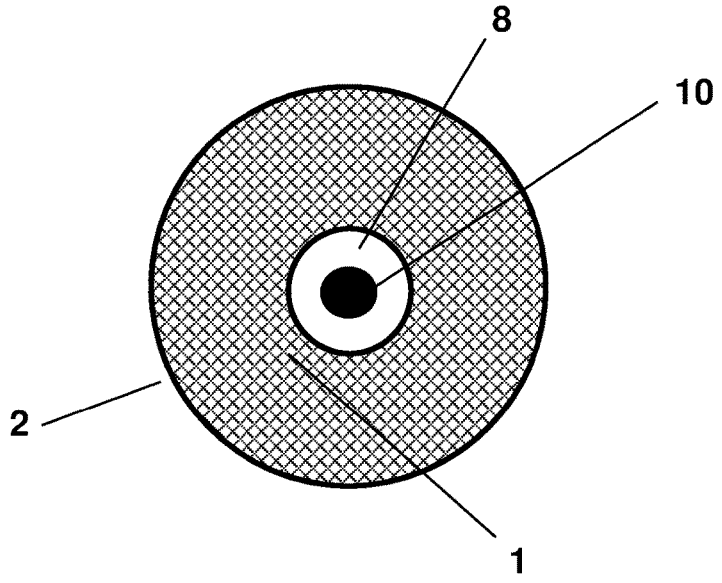
FIG. 1 shows a cross section of a counter mass container.

FIG. 1 shows a cross section of a container 2 containing counter mass material in channels 1 surrounding the cores 8 and 10. According to one embodiment, a container such as container 2 may comprise propellant and/or ignition charge in addition to counter mass material. Preferably, propellant and/or ignition material is contained in the central channels, e.g. in two or more central channels of the inner core 10 of the container. According to one embodiment, the central channels, e.g. two or more central channels of the outer core 8 may contain counter mass material, propellant and/or ignition material. At least some of the surrounding channels 1 may be partially or entirely free from counter mass material, i.e. some of the surrounding channels may contain counter mass material whereas other containers may be free of counter mass material. Preferably, the counter mass container 2 comprises square-shaped channels. Preferably, the container 2 is fabricated of an inert material such as plastic or paper or a combustible material such as nitrocellulose.

Figure 2A:
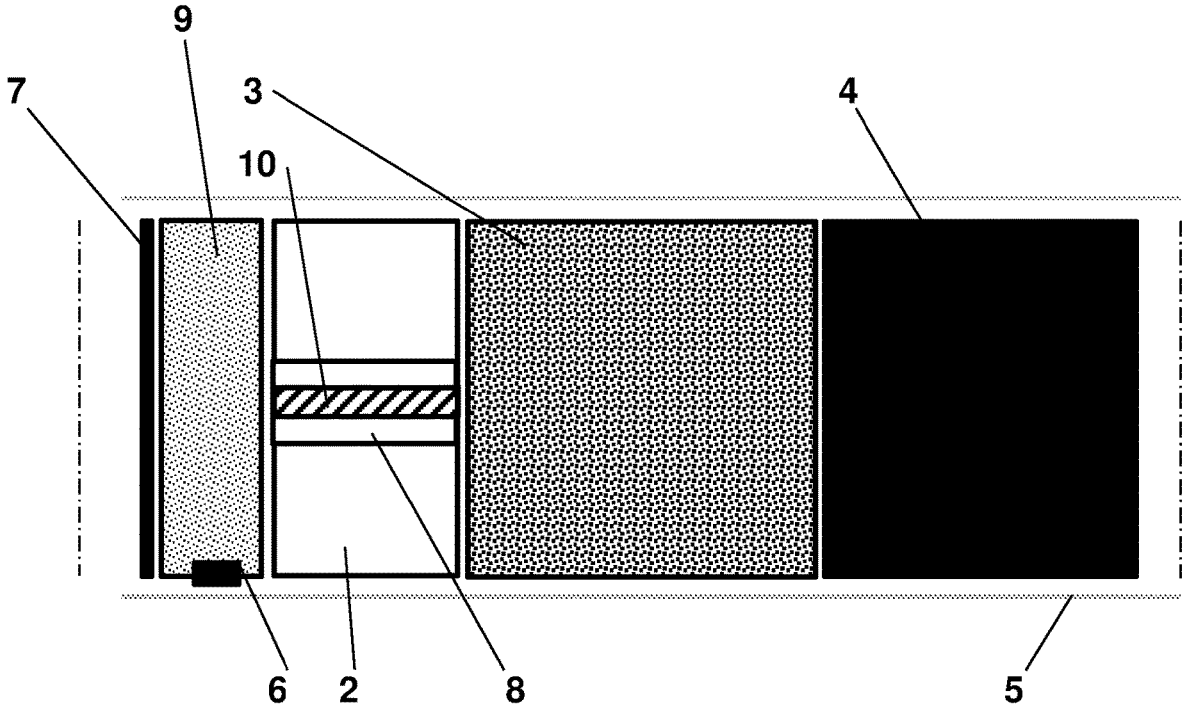
FIG. 2*a-b* schematically illustrate a side view of a counter mass arrangement.

FIG. 2*a* shows a barrel 5 accommodating a projectile 4, a propellant enclosed in a propellant container 3, a counter mass container 2 corresponding to the cross section of FIG. 1. A primer 6 is arranged to the container adjacent the barrel 5. A bursting disc (end plate) 7 is arranged at the rearmost part of the barrel 5.

The rearmost container may comprise an ignition charge 9 and a peripherally positioned primer 6. The ignition charge may be a mixture of propellant and particles, for example a mixture of black powder and zirconium particles.

Figure 2B:
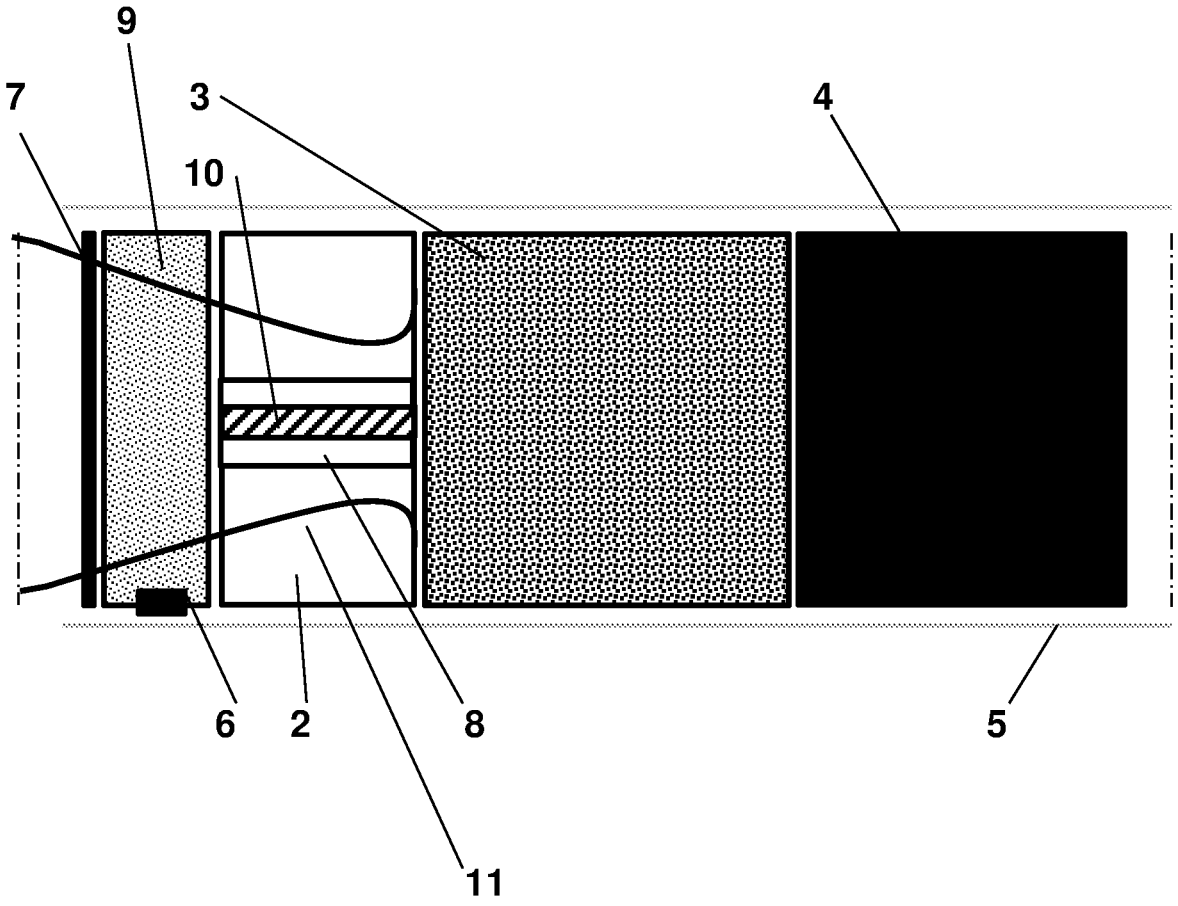

FIG. 2*b* shows a fluidization state of the counter mass subsequent to ignition by the the primer 6 of the ignition charge and the propellant. As the combusted propellant gases expand, formation of a cloud-like fluid of gases and counter mass material is initiated flowing towards the end plate. The zone 11 (at a certain point in time, e.g. 5 ms after ignition of the ignition charge) is shown in which fluid will start to exit the barrel in a homogeneous manner. Preferably, this design enables a Laval type expansion carrying counter mass at supersonic velocity.

Figure 3A:
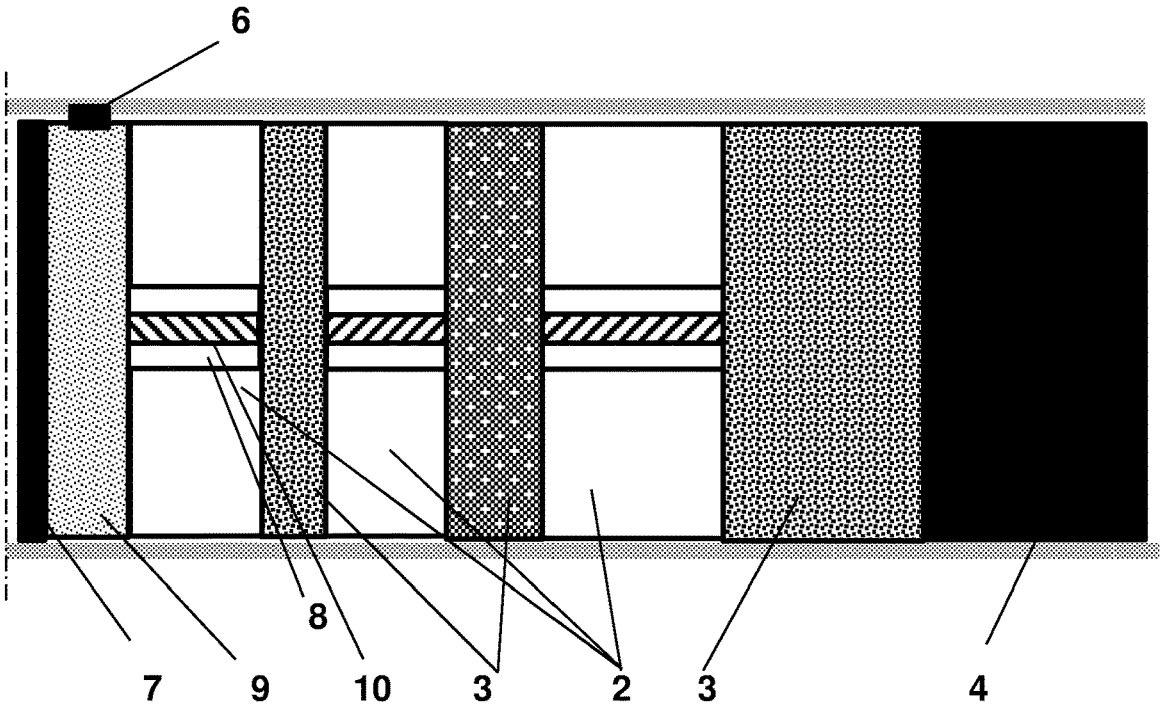
FIG. 3*a-b* show an arrangement of a plurality of counter mass containers and propellant containers.

FIG. 3*a* shows an assembly comprising a plurality of counter mass containers 2 corresponding to the counter mass container of FIG. 2*a*. Plural intermediate propellant containers 3 are positioned between the counter mass containers 2. The central channels in cores 8 and 10 are as described in e.g. FIG. 2*a*.

Figure 3B:
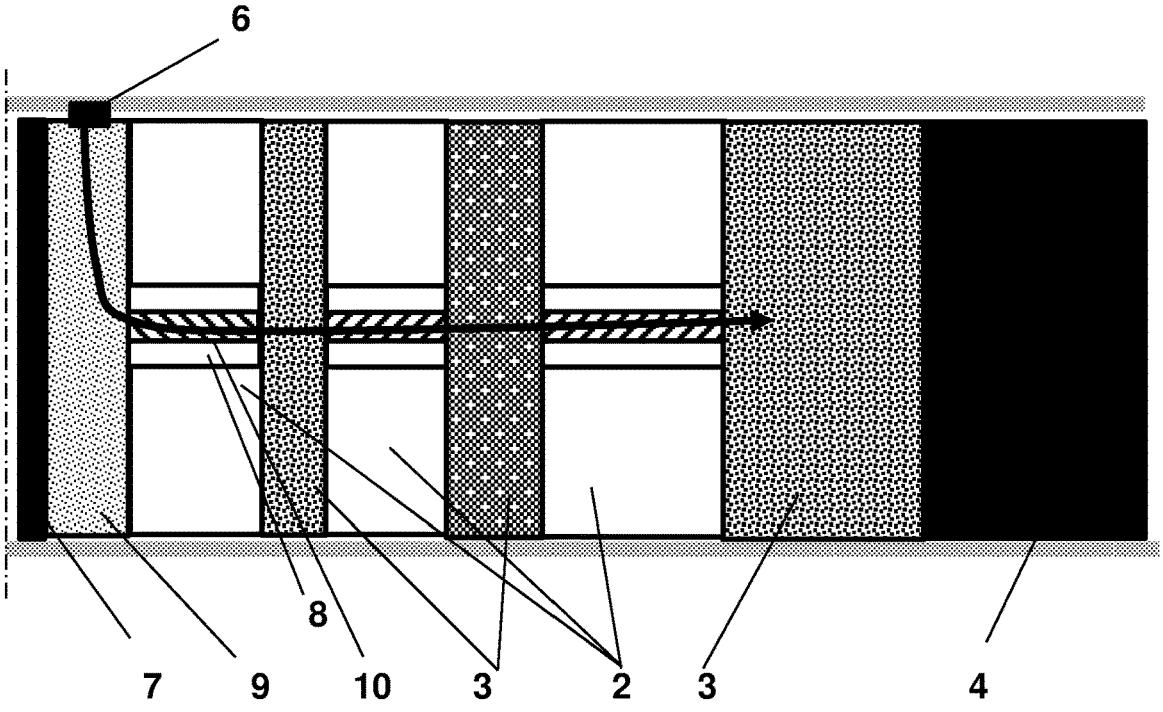

FIG. 3*b* shows the counter mass container assembly after ignition of the ignition charge 9 and propellant. Fluidization occurs subsequent to ignition of the propellant whereby combusted propellant gases and counter mass material form a cloud-like solid-gas mixture maintaining a high pressure whereby the projectile is propelled in the fire direction and the fluid of counter mass and combusted propellant is flowing symmetrically in the opposite direction breaking the end plate. The formed fluid is efficiently reducing or eliminating recoiling forces as the projectile is propelled. From the point in time the primer ignites the ignition charge which may take less than 1 ms, fluidization is thus initiated following combustion of propellant in the counter mass containers which may start within for example 5 ms.

Figure 4:
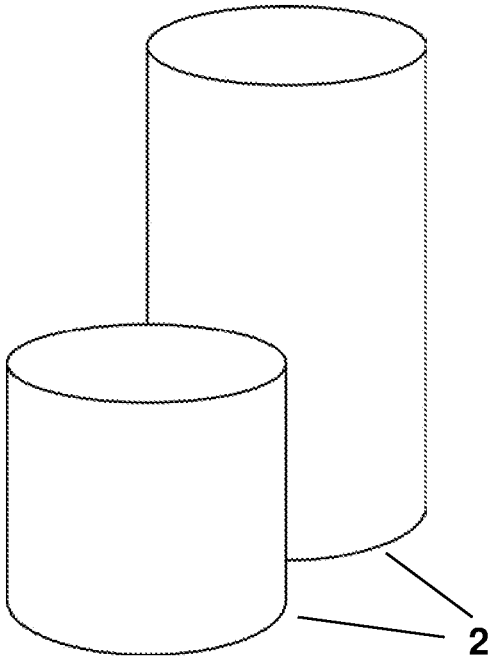
FIG. 4 schematically shows containers suitable for counter mass material and propellant.

FIG. 4 shows counter mass containers 2. The radial extension of the containers is the same. The axial extension of the counter mass containers is different in FIG. 4 and exemplifies containers of different axial lengths may be present in one and the same assembly.

Figure 5:
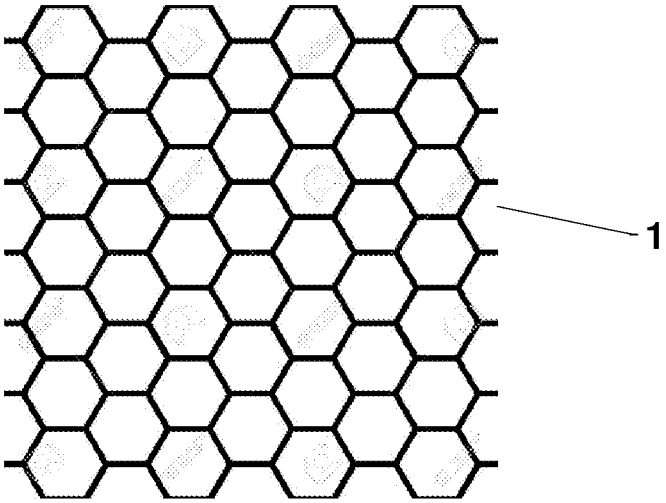
FIG. 5 shows channels with a hexagonal cross section.

FIG. 5 shows a cross section of a container having channels 1 with hexagonal form.

Figure 6:
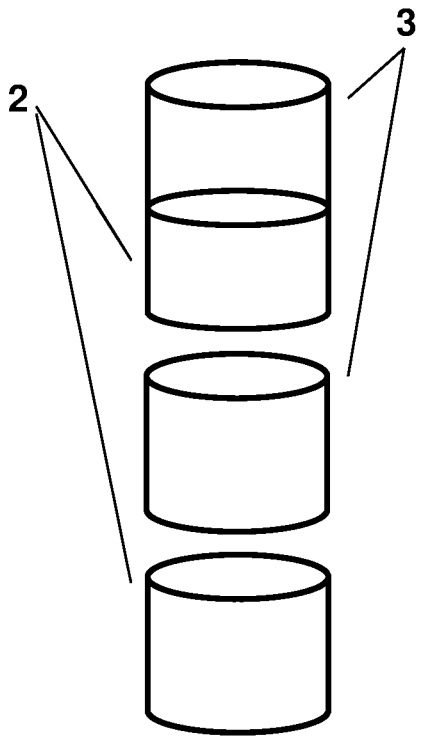
FIG. 6 shows a schematically a plurality of containers for propellants, counter mass material etc (channels not shown).

FIG. 6 shows a plurality of counter mass containers 2 and propellant containers 3 which may be arranged axially with a distance from each other in a barrel. The containers may also be arranged adjacent one another. The containers may also be joined, for example by means of a suitable adhesive. A propellant container 3 may thus be positioned between each counter mass container 2.

Figure 7:
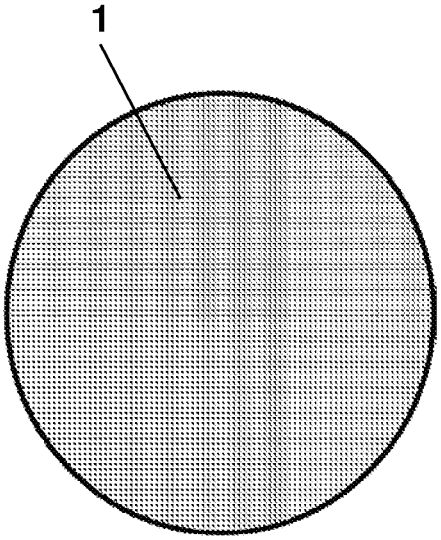
FIG. 7 shows a cross section of square-shaped channels.

FIG. 7 shows a preferred cross section of propellant and counter mass containers with square-shaped channels 1.

The invention claimed is:

1. Counter mass container (2) enclosing a plurality of parallel axially extending channels (1) surrounding cores (8, 10) of the counter mass container (2), the counter mass container (2) being configured to be arranged in a barrel.

2. Counter mass container (2) according to claim 1 containing a counter mass material.

3. Counter mass container (2) according to claim 1, wherein an axial length of the counter mass container ranges from 30 to 150 mm.

4. Counter mass container (2) according to claim 1, wherein a radial length of the counter mass container ranges from 6 to 12 cm.

5. Counter mass container (2) according to claim 1, wherein the diameter of the channels (1) ranges from 5 to 30 mm.

6. Counter mass container (2) according to claim 1, wherein the channels have channel walls having a thickness ranging from 0.1 mm to 2 mm.

7. Counter mass container (2) according to claim 1, wherein a ratio of an axial length of the counter mass container to a radial length of the counter mass container ranges from 0.3 to 2.

8. Counter mass container (2) according to claim 1, wherein a surrounding wall encloses the channels (1).

9. Counter mass container (2) according to claim 1, wherein the channels (1) have a hexagonal cross section.

10. Counter mass container (2) according to claim 1, wherein the container is made of a polymeric material.

11. Assembly of a plurality of counter mass containers (2) according to claim 1.

12. Assembly according to claim 11, wherein from 2 to 100 containers are comprised.

13. Assembly according to claim 11, wherein at least one propellant container (3) is arranged between said plurality of counter mass containers (2).

14. Assembly according to claim 11, wherein at least one counter mass container (2) and at least one propellant container (3) are arranged adjacent to one another.

15. Assembly according to claim 1, wherein a fuse is arranged to ignite a propellant contained in at least one propellant container arranged between a projectile and the counter mass container.

16. Assembly according to claim 11, further comprising at least one propellant container (3).

17. Weapon comprising a barrel (5) accommodating an assembly according to claim 11.

18. Counter mass container (2) enclosing a plurality of parallel axially extending channels (1) surrounding cores (8, 10) of the counter mass container (2), wherein a fuse is arranged to ignite a propellant contained in at least one propellant container arranged between a projectile and the counter mass container.

19. Weapon comprising a barrel (5) accommodating an assembly of a plurality of counter mass containers (2) each enclosing a plurality of parallel axially extending channels (1) surrounding cores (8, 10) of the counter mass container (2).

* * * * *